US009568162B2

(12) United States Patent
Tuttle

(10) Patent No.: US 9,568,162 B2
(45) Date of Patent: Feb. 14, 2017

(54) EASILY ASSEMBLED AND DISASSEMBLED FURNISHING

(71) Applicant: Michael T. Tuttle, Indianapolis, IN (US)

(72) Inventor: Michael T. Tuttle, Indianapolis, IN (US)

( * ) Notice: Subject to any disclaimer, the term of this patent is extended or adjusted under 35 U.S.C. 154(b) by 150 days.

(21) Appl. No.: 13/621,370

(22) Filed: Sep. 17, 2012

(65) Prior Publication Data

US 2014/0078756 A1 Mar. 20, 2014

(51) Int. Cl.

| | |
|---|---|
| ***F21V 21/00*** | (2006.01) |
| ***F21V 1/14*** | (2006.01) |
| ***F21V 1/16*** | (2006.01) |
| ***F21V 1/18*** | (2006.01) |
| ***F21V 17/00*** | (2006.01) |
| *F21S 8/06* | (2006.01) |
| *F21V 1/26* | (2006.01) |
| *F21W 121/00* | (2006.01) |

(52) U.S. Cl.

CPC ..... *F21V 1/146* (2013.01); *F21V 1/16* (2013.01); *F21V 1/18* (2013.01); *F21V 17/007* (2013.01); *F21S 8/06* (2013.01); *F21V 1/26* (2013.01); *F21W 2121/00* (2013.01)

(58) Field of Classification Search

CPC ..... F21V 1/146; F21V 17/007; F21V 1/16; F21V 1/18

USPC ..... 362/382

See application file for complete search history.

(56) References Cited

U.S. PATENT DOCUMENTS

| | | | | |
|---|---|---|---|---|
| 5,645,343 | A * | 7/1997 | Rinehimer | 362/235 |
| 6,352,355 | B1 * | 3/2002 | Law | D04D 9/04 362/234 |
| 2006/0285333 | A1 * | 12/2006 | Bin | F21V 17/007 362/352 |
| 2010/0039800 | A1 * | 2/2010 | Imperial | 362/154 |

* cited by examiner

*Primary Examiner* — Joseph L Williams

(74) *Attorney, Agent, or Firm* — Maginot, Moore & Beck, LLP

(57) ABSTRACT

An easily assembled furnishing article includes a plurality of elongated ribs having a decorative contour, a support plate and a secondary plate. A notched interface is provided between each of the ribs and each plate so that the ribs may be engaged around the perimeter of the plates to define the outer contours of the furnishing article. The notched interface is sized for a friction fit between the ribs and the plates and for easy manual engagement without the need for tools. In one embodiment the furnishing article is a light fixture in which the support plate defines a center opening for supporting a light socket and the secondary plate defines a center opening to receive a power cord of the socket therethrough. The support plate can define a plurality of interior openings to provide for heat convection away from a light bulb engaged within the socket.

15 Claims, 5 Drawing Sheets

EASILY ASSEMBLED AND DISASSEMBLED FURNISHING

BACKGROUND

The present invention relates to furnishings, such as light fixtures, and particularly to furnishings that may be easily assembled or disassembled.

Low-cost furnishings are often desirable, such as for a college student or a person with a limited budget for less essential furnishings. Many furnishings are made low cost by requiring the purchaser to assemble the item. The assembly can be time consuming and may require tools or skills not available to the purchaser. Moreover, may so called "ready-to-assemble" furnishings cannot be disassembled, at least one easily, for transport and/or storage.

Many low cost furnishings are formed of plastic and/or are exceptionally unattractive. For many people it is important to purchase "green" furnishings that are formed of recycled material and/or recyclable themselves. Thus, any articles formed of plastic would be very undesirable. On the other hand, "green" materials are often not easily used for attractive furnishings.

There is a need for low-cost furnishings that are attractive, easily assembled and disassembled and inexpensive.

SUMMARY

An easily assembled furnishing article comprises a plurality of elongated ribs having a decorative contour, a support plate and a secondary plate. A notched interface is provided between each of the ribs and each plate so that the ribs may be engaged around the perimeter of the plates to define the outer contours of the furnishing. The notched interface is sized for a friction fit between the ribs and the plates and for easy manual engagement without the need for tools.

In one embodiment the furnishing article is a light fixture in which the support plate defines a center opening for supporting a light socket and the secondary plate defines a center opening to receive a power cord of the socket therethrough. The support plate can define a plurality of interior openings to provide for heat convection away from a light bulb engaged within the socket. The support and secondary plates may be circular with the ribs distributed around the circumference of the plates. At least three ribs are needed for the structural integrity of the light fixture; however, at least ten ribs and preferably 24 ribs are provided for optimum structural integrity. The ribs may be identical with the same outer contour to provide a uniform decorative appearance to the light fixture. Alternatively the ribs may have different contours to provide a more eclectic appearance, without sacrificing the easy of assembly and disassembly of the light fixture.

In one embodiment, the ribs and plates are formed of a recyclable material, such as a corrugated cardboard. In one aspect of the present disclosure, the components may be laser cut from a sheet of material. The laser cut for the plurality of ribs forms notches at the location of the support and secondary plates. In one embodiment, the support plate also defines a like plurality of notches at the perimeter of the plate to mate with the notches in the ribs. The secondary plate may or may not incorporate a like plurality of notches, depending upon the size or surface area of the plate. The use of laser cutting allows production of the components for a given furnishing article to be formed from a common sheet of material. Moreover, the use of laser cutting simplifies making changes to the components, such as the contour of the ribs.

DETAILED DESCRIPTION

Figure 1:
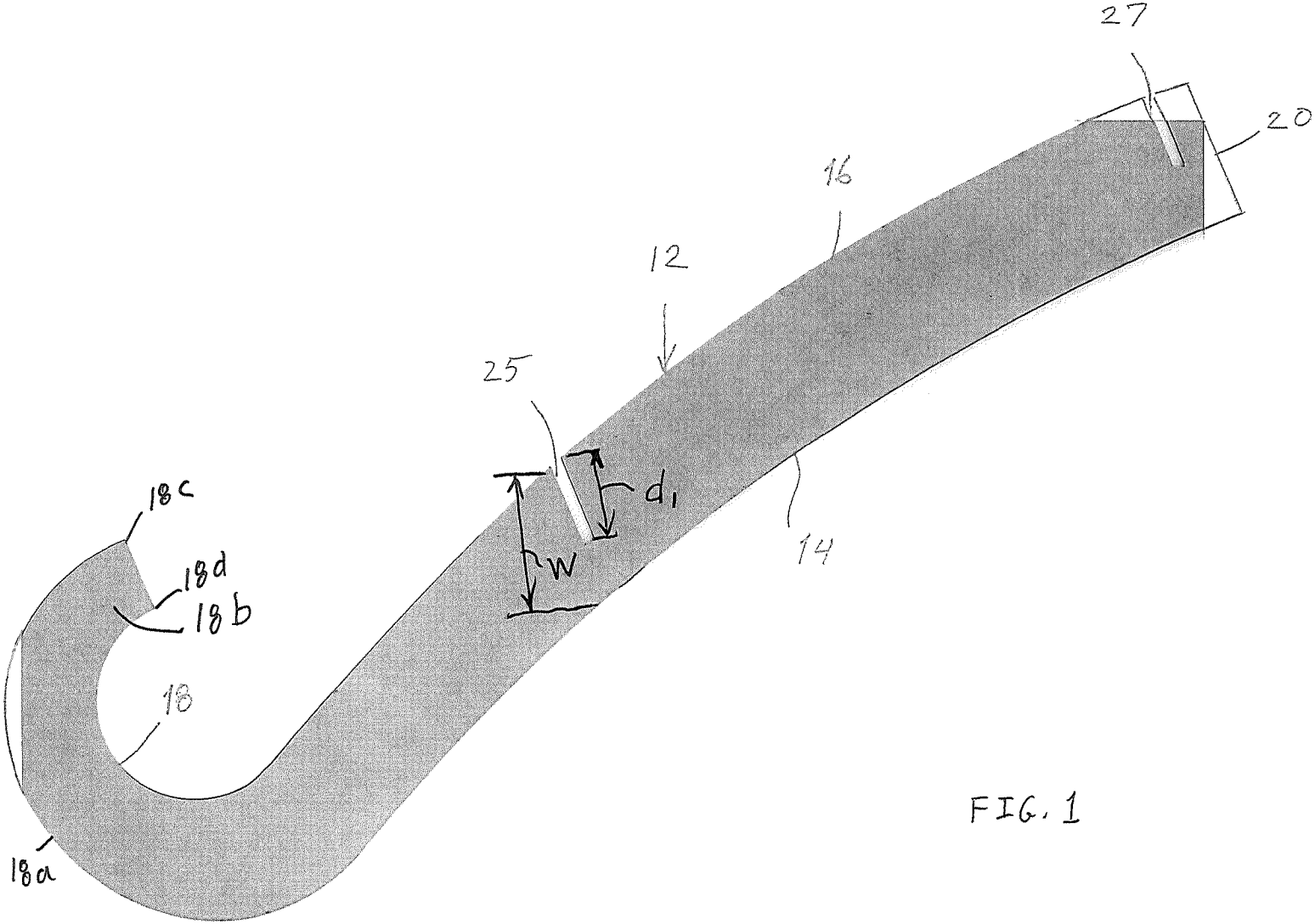
FIG. 1 is a plan view of a rib used in the construction of an easily assembled furnishing article according to one disclosed embodiment.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
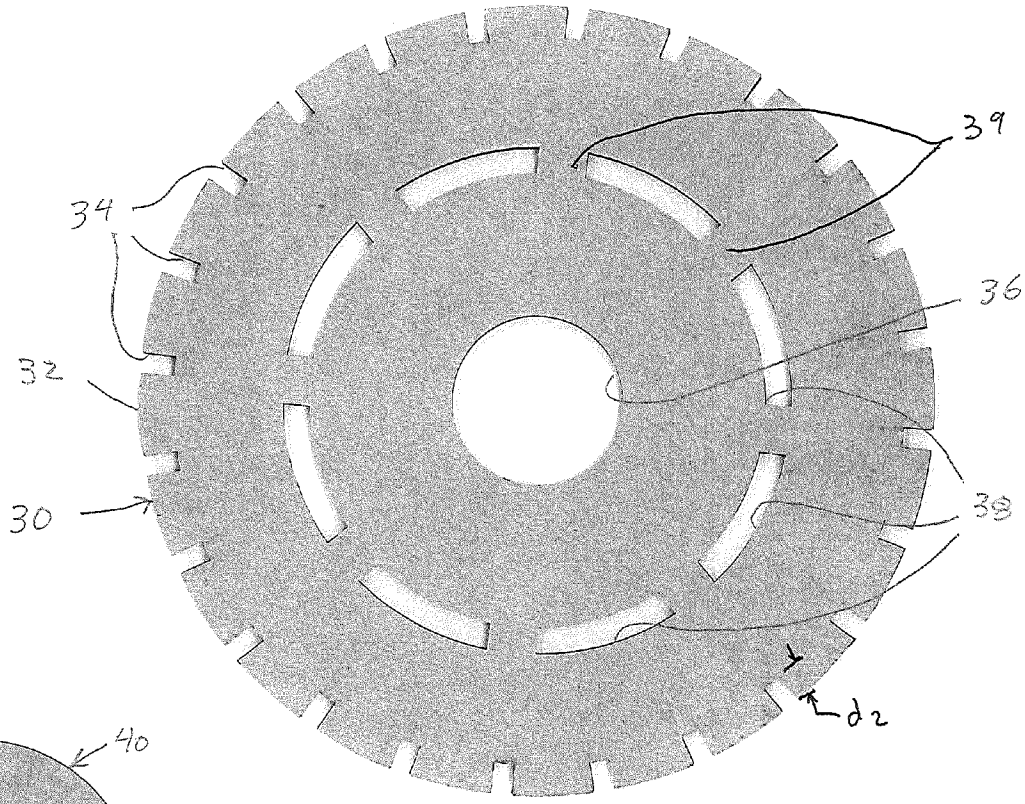
FIG. 2 is a plan view of a support plate with the rib of FIG. 1 in the construction of the furnishing article.
Figure 3:
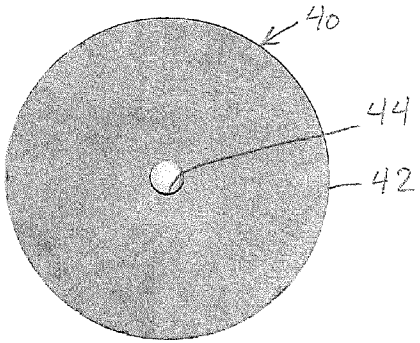
FIG. 3 is a plan view of a secondary plate with the rib of FIG. 1 and support plate of FIG. 2 in the construction of the furnishing article.

Components of one embodiment of an easily assembled furnishing article are shown in FIGS. 1-3. A rib 12 is illustrated in FIG. 1 that is cut from a generally planar sheet of material to define an outer edge 14, an inner edge 16, a lower portion 18 and an upper portion. In the illustrated embodiment the outer edge 14 may have a decorative contour to define the overall exterior shape of the furnishing once a plurality of such ribs 12 are assembled, as described herein. The inner edge 16 may be contoured to define an interior envelope E (FIG. 7) of the furnishing article, as discussed herein. The lower portion 18 can exhibit different contours depending upon the nature of the furnishing article. For instance, the lower portion 18 of FIG. 1 includes a lower edge 18*a* that may be configured to support the article on a surface. For instance, if the furnishing is a light fixture, the assembled furnishing article the lower edge 18*a* of a plurality of ribs 12 may be placed on the surface of a table. In the embodiment of FIG. 1, the lower portion 18 includes an inwardly curved segment 18*b* that can provide structural rigidity to each rib at the point of contact with the table surface. In addition, curving the lower portion away from the table surface offsets the leading and trailing ends 18*c, d* of the rib from the table that might otherwise be damaged when the furnishing article is moved on the table surface. As just described, the furnishing article may be a pedestal lamp; however, the same contoured lower portion 18 may provide an aesthetic feature for a pendant light, such as the light 10 shown in FIG. 6.

Returning to FIG. 1, each rib 12 is provided with a pair of notches or slots 25, 27 defined in the inner edge 16. The notches cooperate with the other components of the furnishing shown in FIGS. 2-3 so that the components may be manually assembled and disassembled. In particular, the components disclosed herein incorporate a notched interface sized for a friction fit between the components, as described herein.

Referring to FIG. 2 a second component of the furnishing is a support plate 30. The support plate 30 includes an outer perimeter 32 that is interrupted by a series of notches 34. The number of notches 34 matches the number of ribs 12 in the assembled furnishing article. The notches are preferably uniformly spaced around the perimeter 32 for optimum structural integrity of the assembled article. At a minimum, three ribs 12 and corresponding notches 34 in the support plate 30 are provided. However, to provide optimum structural integrity at least ten ribs and corresponding notches are provided. In the illustrated embodiment twenty-four ribs 12 engage twenty-four notches 34 in the support plate 30 to produce the light fixture furnishing illustrated in FIG. 6. In the embodiment of FIG. 2 the support plate 30 is provided with a center opening 36 that is sized to receive a light socket S (FIG. 7) for the light fixture furnishing of FIG. 6. The light socket S may be of conventional design to support a light bulb B within the interior envelope E formed by the inner edges 16 of the assembled plurality of ribs 12.

The third component of the furnishing article is a secondary plate 40, as shown in FIG. 3. The secondary plate 40 includes an outer perimeter 42 that meshes with the one of the notches 25, 27 of the ribs 12. Depending upon the size of the secondary plate, the perimeter 42 may be provided with notches in a manner similar to the notches 32 of the primary plate 30. However, in the embodiment of FIGS. 1-7, no such notches are provided because forming notches in the perimeter 42 would compromise the integrity of the plate 40. The plate 40 defines a center opening 44 that is sized for passage of a power cord C (FIG. 6) that is part of the light socket S.

Figure 4:
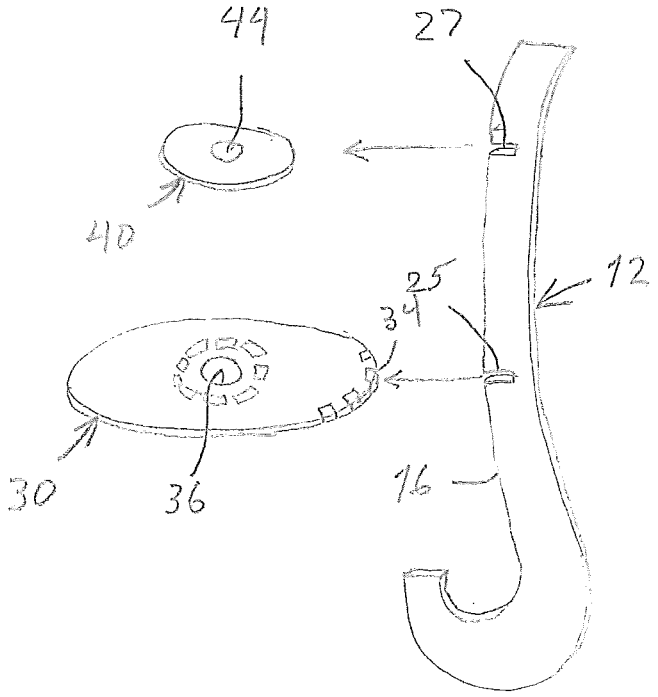
FIG. 4 is a perspective view of a first step in constructing the furnishing article using the components of FIGS. 1-3.
Figure 5:
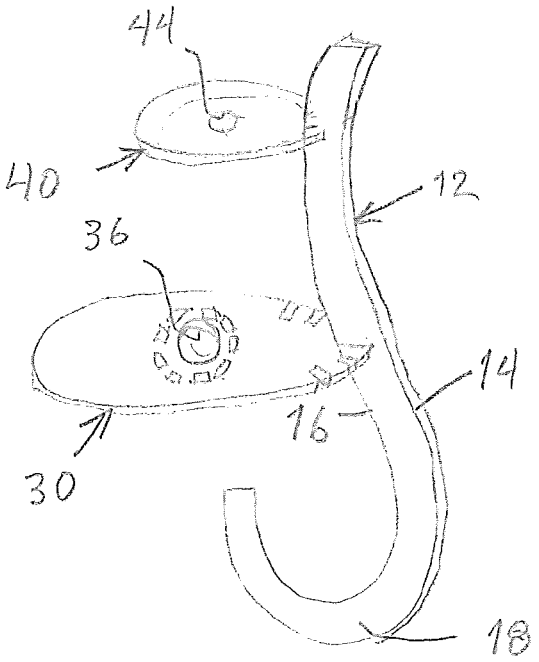
FIG. 5 is a perspective view of a partially constructed furnishing article using the components of FIGS. 1-3.

Initial steps in the assembly of the light fixture furnishing 10 are shown in FIGS. 4-5. In particular, the primary plate 30 is aligned with the notch 25 in the rib 12, while the secondary plate 40 is aligned with the notch 27 at the upper portion of the rib. The two plates are pushed into the corresponding notches so that the three components are held together by a friction fit. It can be appreciated that the notched interface between these components is sized to accept the friction fit without damaging the inner edge 16 of the rib 12 or the perimeters 32, 42 of the plates 30, 40. Thus, the thickness of the plates may be equal to or slightly greater than the width of the notches 25, 27. The components may also be formed of a material that can be resiliently deformed by the notched friction fit engagement. However, in order to preserve the ability of the furnishing to be manually assembled and disassembled several times the friction fit should be moderate so that the components may be assembled without much manual pressure.

It can be appreciated that in engaging the support plate 30 to the rib 12 it is necessary to align and engage a notch 34 of the plate 30 with a notch 25 of the rib 12. The support plate is configured and arranged to be the principal structural element for holding the assembled components together. Moreover, since the support plate supports the socket S and light bulb B it is important that the interface between the plate 30 and ribs 12 be as solid as possible to avoid unintentional disengagement between the components. Thus, the depth d1 of the notch 25 in the rib and the depth d2 of the notch 34 in the plate 30 are calibrated to provide an optimum frictional engagement without compromising the structural integrity of either component. In one embodiment, the depth d2 of the notches in the plate 30 is slightly less than the difference between the width w of the rib 12 at the notch 25 and the depth d1 of the notch. In one specific embodiment, the ribs have a width w of about 2 in. and a notch depth d1 of about 1.25 in., while the notch 34 has a depth d2 of about 0.25 in. It can be appreciated that the friction fit between the rib and the support plate extends along the entire depth d1. The depth of the notch 27 in the rib that engages the secondary plate 40 must be sufficient to provide a desirable friction fit between the two components. However, in furnishing articles in which the secondary plate does not support another component the notch 27 need not be as deep as the notch 25 in the support plate. In one specific embodiment, the notch 27 has a depth of about 1.0 in.

Figure 6:
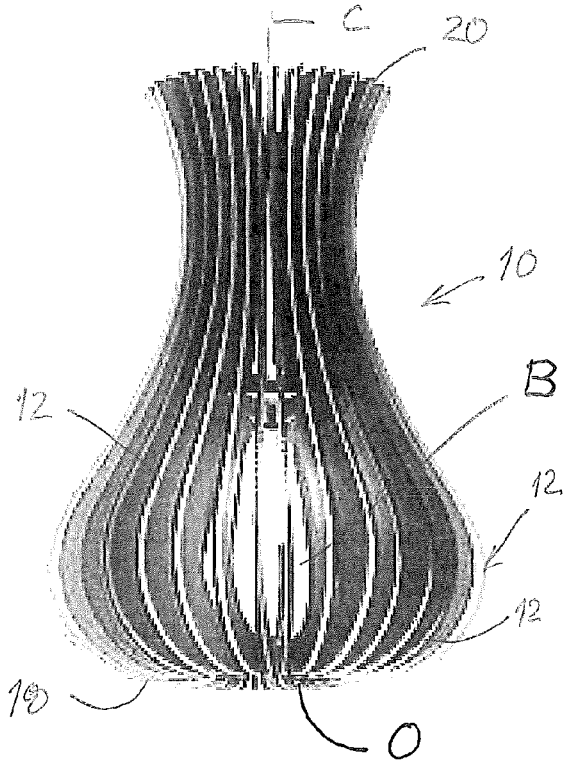
FIG. 6 is a perspective view of the fully constructed furnishing using the components of FIGS. 1-3.
Figure 7:
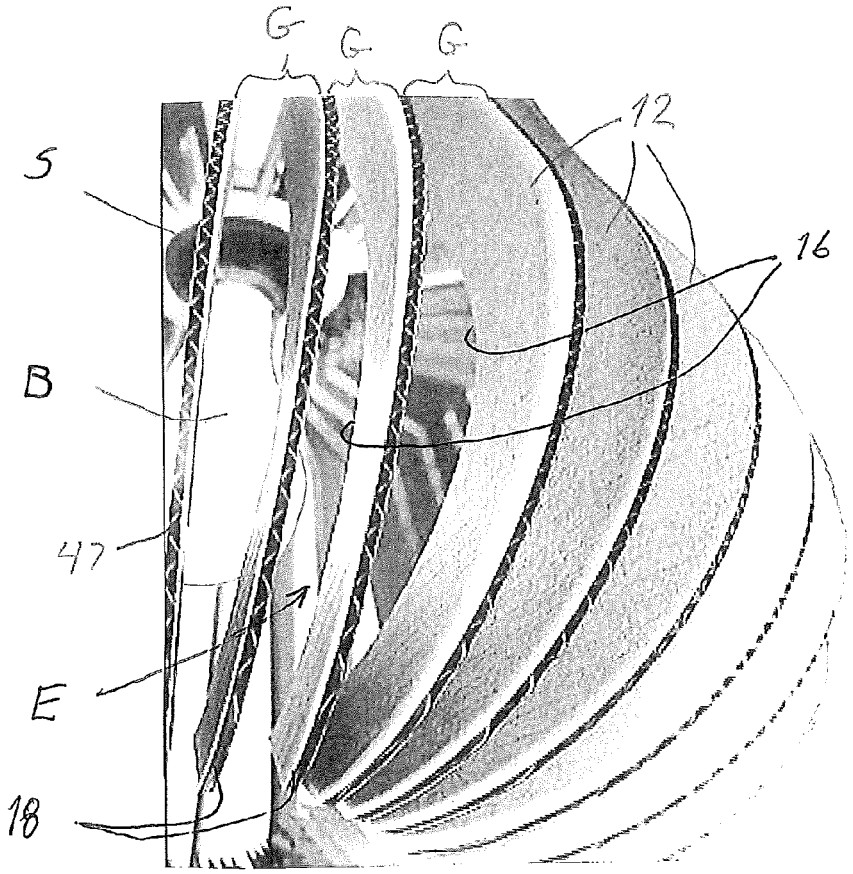
FIG. 7 is an enlarged view of the furnishing of FIG. 6 showing the socket and light bulb mounted within the furnishing.
Figure 8:
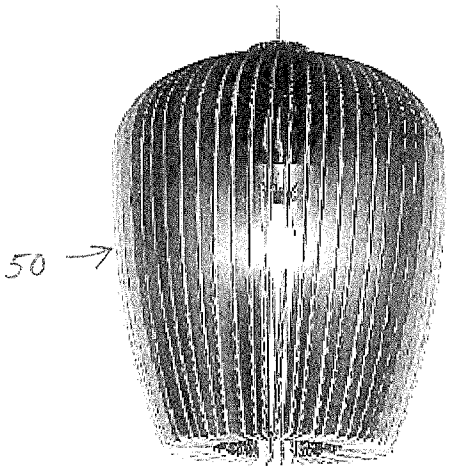
FIGS. 8-11 are perspective views of fully constructed furnishing articles according to further embodiments disclosed herein.
Figure 9:
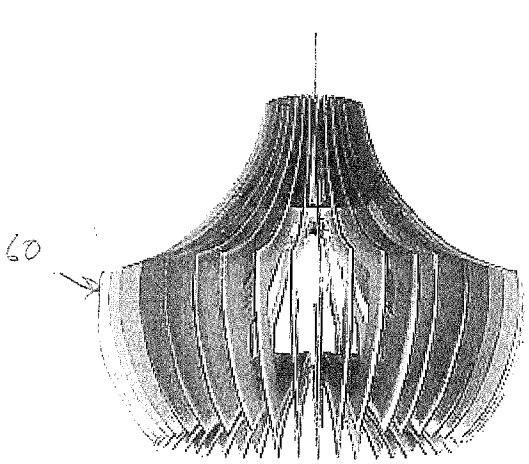
Figure 10:
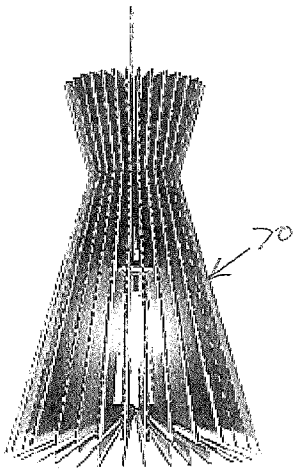
Figure 11:
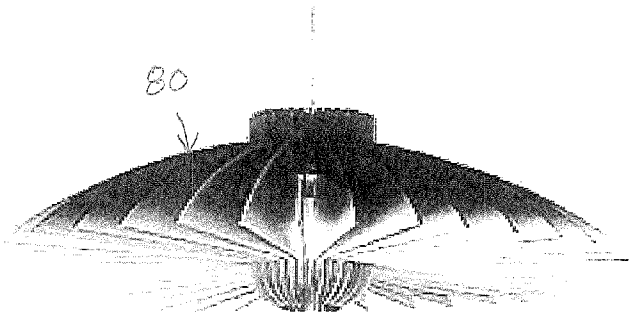

The completed assembly of one rib to the support and secondary plates is depicted in FIG. 5. The same steps are followed for the remaining of the plurality of ribs until the furnishing is completed, as shown in FIG. 6. It can be appreciated that this assembly does not require any tools and may be easily done manually. It can be further appreciated that disassembly of the furnishing can be accomplished by manually pulling each rib from the notched friction fit engagement with the two plates. As shown in FIG. 7, the inner edges 16 of the plurality of ribs cooperate to define an enclosure E. The contour of the edges 16 in the light fixture of FIG. 6 must be sufficiently removed from the light bulb to avoid contact and to minimize the heat transfer from the energized light bulb and the ribs. In addition, the lower portions 18 of the ribs 12 are configured to provide a central opening O (FIG. 6) to provide access to change the light bulb B.

As further shown in FIG. 7, the ribs 12 are positioned to define a gap G between each rib. The gap G provides a path for passage of light from the light bulb B as well as a convection path for heat generated by the bulb. The width of the gap G depends upon the number of ribs and the length of the perimeter of the support plate 30. It can be appreciated that the purchaser can alter the number and arrangement of ribs to adjust the size and number of gaps G as desired for decorative and/or functional purposes.

In a further feature, the support plate 30 defines a plurality of interior openings 38. In the illustrated embodiment the openings are arc segment slots positioned concentrically about the center opening 36. The openings 38 provide a convection path for heat rising from the energized light bulb B. In addition, the openings provide a light path to enhance the decorative effect of the light fixture. The openings 38 are sized and arranged so that the lands 39 between openings are sufficiently wide to preserve the structural integrity of the plate 30. In the illustrated embodiment, the lands 39 have a width of about 0.50 in. The openings 38 can be in the form of curved slots having a width of about 0.25 in.

The support plate 30 and secondary plate 40 may serve as the base for other configurations of ribs, as demonstrated by the light fixtures 50, 60, 70 and 80 in FIGS. 8-11. In these examples the furnishing articles are pendant lights in which the support plate 30 carries the socket that is suspended from a ceiling. However, it can be appreciated that some of these configurations can be used as a table lamp, such as by inverting the orientation of the article. It can also be appreciated that the outer edges 14 of the ribs may have many other contours, provided that the contour of the inner edges 16 allow engagement with the plates 30, 40 and form a sufficient envelope E surrounding the bulb B.

In the embodiment of FIGS. 1-7, the plates 30, 40, are circular with the ribs positioned concentrically around the circular perimeter of the plates. It can be appreciated that the plates may have other configurations to produce different aesthetic appearances for the assembled article. Thus, one or both plates may be oval, square, rectangular, hexagonal, octagonal, or an irregular shape. Moreover, the orientation of the notches 25, 27, 34 may be modified to alter the relative orientation between the ribs and the plates. In the illustrated embodiment the notches are cut into the components so that the notched interface is generally perpendicular between mated components. Alternatively the notches may be cut at an angle in the components so that the ribs engage the plates at a non-perpendicular angle.

The components 12, 30 and 40 of the furnishing articles disclosed herein can be easily made from sheet material. In one embodiment, the sheet material is a cardboard, and preferably a corrugated cardboard. In a specific embodiment, the material is an internally corrugated cardboard having a thickness of about 0.125 in. The corrugated cardboard is slightly compressible to facilitate the friction fit at the notched engagement between the ribs and the plates. In this embodiment the material is recyclable or, at a minimum, biodegradable.

Other materials are contemplated that are preferably suited for the friction fit notched engagement described above. Moreover, in order to facilitate production of the components the material is preferably provided in sheet form and capable of laser cutting. The material of at least the support plate 30 must be sufficiently rigid and strong to support the entire furnishing article. This same strength may be required in the ribs 12 if they are used to support the article on a surface. Finally, a most preferred material would be "green", either by being formed from recycled materials or by being recyclable itself. The corrugated cardboard described above meets all these criteria. Another suitable material is cork. Both cork and cardboard have the added feature of being lightweight materials, which is particularly beneficial for a pendant lamp that is intended to be suspended by the lamp power cord.

Depending upon the nature of the furnishing article the components may treated with a particular composition. For instance, in the illustrated embodiments the furnishing articles are light fixtures and the components are formed from a corrugated cardboard. The components maybe treated with a heat resistant and fire retardant composition to eliminate any risks to the article from heat generated by the energized light bulb B. The composition can not only prevent the components from igniting, it can also prevent discoloration that can occur from exposure to the light bulb generated heat. The components may also be treated with a coloring composition to augment the decorative aspect of the furnishing article. Depending upon the material, the article may be treated with a moisture barrier composition to prevent ambient moisture from being absorbed into the material, or even a water repellant composition.

The components may be laser cut from the sheet of material, which greatly simplifies production of the components. The array of components can be laid out in a pattern on the sheet of material to minimize waste. As is known in the art, the laser cutter may be controlled automatically such as by way of a programmable controller or programmable software. One benefit of laser cutting is that the contour of the ribs may be readily modified to produce a furnishing article having a different aesthetic appearance. For instance, the ribs for the pendant lamp of FIG. 6 may be cut followed by the ribs for the lamp of FIG. 11 by simply supplying a different cut plan to the laser cutter. The change in rib contour is as easy as changing the programmable input to the laser cutter.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A furnishing article comprising:

a plurality of planar ribs having an outer edge, an inner edge and a thickness at said inner edge, the outer edge defining an aesthetic contour;

a planar support plate having an outer perimeter;

a planar secondary plate having an outer perimeter; and a friction fit notched interface between each of said plurality of planar ribs and the outer perimeter of said support plate and between each of said plurality of planar ribs and the outer perimeter of said secondary plate, said notched interface configured so that said outer edge of said ribs defines the exterior of the furnishing article when the plurality of ribs are engaged to said support plate and said secondary plate at said notched interface, said notched interface including a plurality of notches defined in each of said support plate and said secondary plate configured for engagement of said ribs in the direction of the plane of both said support plate and said secondary plate, said notches having a width less than said thickness of said ribs to form said friction fit.

2. The furnishing article of claim 1, wherein at least said plurality of planar ribs are formed of a corrugated cardboard.

3. The furnishing article of claim 2, wherein said support plate and said secondary plate are formed of corrugated cardboard.

4. The furnishing article of claim 3, wherein said corrugate cardboard is treated with at least a fire retardant composition.

5. The furnishing article of claim 1, wherein said support plate defines a central opening sized to support a socket for a light bulb.

6. The furnishing article of claim 5, wherein said secondary plate defines a center opening sized to receive a power cord of the socket for a light bulb.

7. The furnishing article of claim 5, wherein said support plate further defines a plurality of interior openings between the perimeter and said central opening.

8. The furnishing article of claim 1, wherein said plurality of ribs, said support plate and said secondary plate are cut from a common sheet of material.

9. The furnishing article of claim 8, wherein the cut is made by a laser.

10. The furnishing article of claim 1, wherein said inner edge of each of said plurality of ribs is contoured to define an enclosure adjacent said support plate when the plurality of ribs are engaged to said support plate and said secondary plate at said notched interface.

11. A furnishing article, comprising:

a plurality of planar ribs having an outer edge and an inner edge, the outer edge defining an aesthetic contour;

a planar support plate having an outer perimeter;

a planar secondary plate having an outer perimeter; and a friction fit notched interface between each of said plurality of planar ribs and the outer perimeter of said support plate and between each of said plurality of planar ribs and the outer perimeter of said secondary plate, said notched interface configured so that said outer edge of said ribs defines the exterior of the furnishing article when the plurality of ribs are engaged to said support plate and said secondary plate at said notched interface, said notched interface further configured for engagement in the direction of the plane of both said support plate and said secondary plate, wherein said notched interface includes at least one notch defined in said inner edge of each of said plurality of ribs, said at least one notch arranged to engage one of said support plate or said secondary plate, and said at least one notch configured as a slot in the direction of the plane of said one of said support plate or said secondary plate.

12. The furnishing article of claim 11, wherein said notched interface includes two notches defined in said inner edge and spaced apart from each other, each of said two notches arranged to engage a corresponding one of said support plate and said secondary plate, and each of said two notches configured as a slot in the direction of the plane of said corresponding one of said support plate and said secondary plate.

13. The furnishing article of claim 11, wherein said notched interface includes a plurality of notches defined in the outer perimeter of said support plate and arranged to engage the at least one notch in said plurality of ribs, each of said plurality of notches configured as a slot in the direction of the plane of said one of said support plate or said secondary plates.

14. The furnishing article of claim 13, wherein said support plate is circular and said plurality of notches are equally spaced around the outer perimeter.

15. The furnishing article of claim 14, wherein said plurality of notches includes at least ten notches and said plurality of ribs includes at least ten ribs.

* * * * *